US011131169B2

(12) United States Patent
Wright

(10) Patent No.: US 11,131,169 B2
(45) Date of Patent: Sep. 28, 2021

(54) TUBING ROTATOR AND SAFETY ROD CLAMP ASSEMBLY

(71) Applicant: RISUN OILFLOW SOLUTIONS INC., Nisku (CA)

(72) Inventor: Andrew Wright, Nisku (CA)

(73) Assignee: RISUN OILFLOW SOLUTIONS INC., Nisku (CA)

( * ) Notice: Subject to any disclaimer, the term of this patent is extended or adjusted under 35 U.S.C. 154(b) by 0 days.

(21) Appl. No.: 16/481,952

(22) PCT Filed: Jan. 30, 2018

(86) PCT No.: PCT/CA2018/050107
§ 371 (c)(1),
(2) Date: Jul. 30, 2019

(87) PCT Pub. No.: WO2018/137046
PCT Pub. Date: Aug. 2, 2018

(65) Prior Publication Data

US 2019/0368323 A1 Dec. 5, 2019

Related U.S. Application Data

(60) Provisional application No. 62/452,194, filed on Jan. 30, 2017.

(51) Int. Cl.
*E21B 43/12* (2006.01)
*E21B 33/04* (2006.01)

(52) U.S. Cl.
CPC ..... *E21B 43/12* (2013.01); *E21B 33/0415* (2013.01); *E21B 2200/01* (2020.05)

(58) Field of Classification Search
CPC ... E21B 33/0415; E21B 43/12; E21B 2200/01
See application file for complete search history.

(56) References Cited

U.S. PATENT DOCUMENTS 4,995,457 A 2/1991 Baldridge
5,465,788 A 11/1995 Wright
5,732,777 A 3/1998 Grimshaw et al.
(Continued)

FOREIGN PATENT DOCUMENTS

CA 2845974 9/2015
CA 2941404 11/2016

OTHER PUBLICATIONS

International Search Report and Written Opinion for international (PCT) Patent Application No. PCT/CA2016/050518, dated Aug. 25, 2016, 9 pages.

(Continued)

*Primary Examiner* — James G Sayre
(74) *Attorney, Agent, or Firm* — Foley & Lardner LLP

(57) ABSTRACT

Tubing string rotators, safety rod clamps, combination tubing string rotators and safety rod claims, and rotating split tubing hangers are provided. The tubing string rotator can rotate a tubing string suspended in a hydrocarbon well from a rotatable support mandrel. The support mandrel can be positioned at the well head and can be supported against downward axial movement. The tubing string rotator can comprise a motor for producing a rotational force, a drive assembly for applying the rotational force to drive the rotation of the support mandrel, and a controller operatively connected to the motor for intermittently activating the motor, causing rotation of the support mandrel, for selected intervals of time, followed by selected intervals of time of motor inactivation, in which no rotation of the support mandrel occurs. Intermittently or non-continuously rotation of the tubing string can result in more even wear and/or erosion of the tubing string.

13 Claims, 8 Drawing Sheets

(56) References Cited

U.S. PATENT DOCUMENTS

| | | | | |
|---|---|---|---|---|
| 6,026,898 | A * | 2/2000 | Bland | E21B 33/0415 166/78.1 |
| 6,543,533 | B2 * | 4/2003 | Meek | E21B 33/0415 166/104 |
| 7,306,031 | B2 | 12/2007 | Wright et al. | |
| 7,448,444 | B2 | 11/2008 | Thomson et al. | |
| 8,272,434 | B2 | 9/2012 | Garcia | |
| 2005/0230099 | A1 * | 10/2005 | Thomson | E21B 33/0415 166/78.1 |
| 2006/0225890 | A1 * | 10/2006 | Ray | E21B 33/0415 166/382 |
| 2007/0175625 | A1 | 8/2007 | Lam | |
| 2012/0085552 | A1 * | 4/2012 | Travis | E21B 43/126 166/382 |
| 2013/0319688 | A1 | 12/2013 | Moellendick | |
| 2014/0262342 | A1 | 9/2014 | Obrejanu | |
| 2018/0148990 | A1 | 5/2018 | Wright | |

OTHER PUBLICATIONS

Official Action for U.S. Appl. No. 15/571,559, dated Jul. 23, 2019, 8 pages. Restriction Requirement.

International Search Report prepared by the Canadian Intellectual Property Office for International (PCT) Patent Application No. PCT/CA2018/050107, dated Apr. 9, 2018, 5 pages.

Written Opinion prepared by the Canadian Intellectual Property Office for International (PCT) Patent Application No. PCT/CA2018/050107, dated Apr. 27, 2018, 5 pages.

* cited by examiner

FIGURE 5A
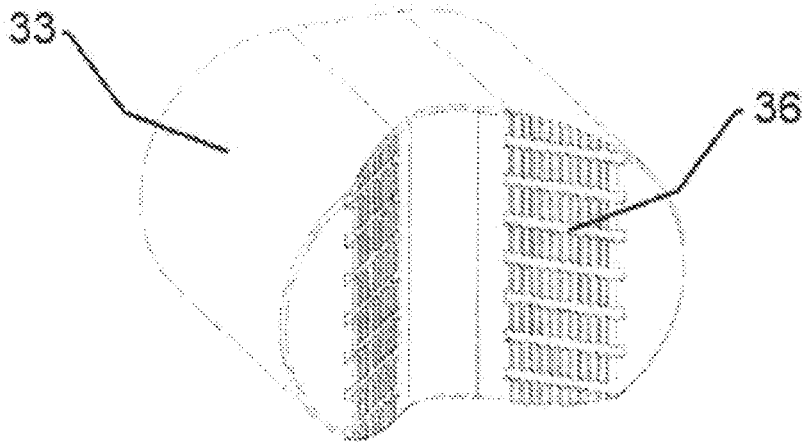
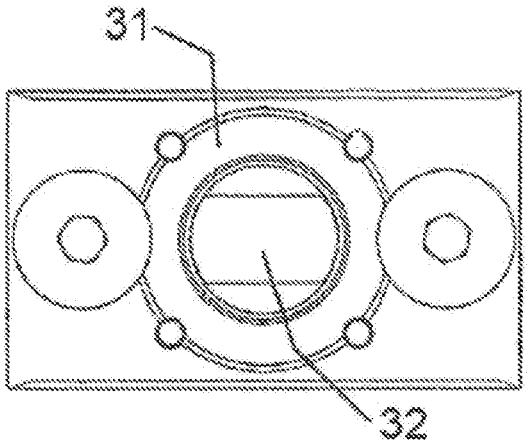
FIGURE 5B

TUBING ROTATOR AND SAFETY ROD CLAMP ASSEMBLY

CROSS REFERENCE TO RELATED APPLICATIONS

This application is a national stage application under 35 U.S.C. 371 and claims the benefit of PCT Application No. PCT/CA2018/050107 having an international filing date of 30 Jan. 2018, which designated the United States, which PCT application claimed the benefit of U.S. Provisional Application No. 62/453,194 filed 30 Jan. 2017, the disclosure of each of which are incorporated herein by reference.

TECHNICAL FIELD

The present disclosure relates to tubing string rotator assemblies for rotating a tubing string within a hydrocarbon fluid well. The present disclosure also relates to safety rod clamp systems for use at the well tubing head or well casing head of a hydrocarbon well.

BACKGROUND OF THE INVENTION

When producing fluids from hydrocarbon wells drilled into subterranean formations, a downhole pump is often placed deep within the well to pump the fluids in the formation to the surface. A tubing string extending from the bottom of the well to the surface is used as the conduit for the fluids to travel to the surface. Also, in some instances, a rotating rod or an up and down axially reciprocating pump rod may extend from the surface to the downhole pump through the interior of the tubing string. The pump rod can be rotated, or moved axially up and down, from the surface to transmit rotational power, or axially movement, to the pump at the bottom of the well, where it can be used to energize the pump.

The type and quantities of hydrocarbon fluids passing through the tubing string, as well as instances where the rotating pump rod comes into contact with the interior surface of the tubing string, can cause wear and erosion of the inner surface of the tubing string. In order to reduce, or at least more evenly distribute, this wear and erosion, it is known to rotate the tubing string suspended in a hydrocarbon well in an attempt to extend the life of the string. Typically, rotation devices, or rotators as they are commonly known, are bolted or otherwise attached to the well head of a hydrocarbon well and connected in some manner to the tubing string to cause the string to rotate. Rotators may use electrical or hydraulic power to cause the string to continuously rotate.

While such prior art rotators are effective at continuously rotating the tubing string, the rotation itself can cause wear at some contact points. For example, if the pump rod contacts the interior of the tubing string at a single point, rotation of the tubing string extends the wear around the entire inner circumference of the tubing string. If left unresolved, the wear around the inner circumference of the tubing string can ultimately cut the tubing string at the depth of the point of contact with the pump rod. There can be many similar wear points depending on the well geometry and the twisting of pump rods. As described, wear can negatively affect the integrity of the tubing string and fluid flow can be diverted from the tubing string.

In addition, rod clamps are used in the oil and gas industry to grip and hold the movement of polish rods during the servicing of the well. These clamps are used to hold the rod in tension and can, for example, sit at the top of the drive head or pumping unit. A polish rod, for example, is sealed with a stuffing box (mounted separately) that rotates with the rod or static seals. The rod clamp does not prevent the rods from coming out of hole if pressure or sand is exerted at the rotor. This can cause the entire working rod string to lift up the clamp with polish rod and become a whip posing a danger at the surface. Also, if the seal contact is lost with the polish rod, the stuffing box would lose pressure sealing. The action of the polish rod that comes out of well bore can damage equipment and operators. The industry standard is to lock the polish rod from moving when there is no rotation or axial movement, so the rod does not move with a locking seal rod blowout preventer (BOP).

In addition, tubing hangers are used to suspend a tubing string in a hydrocarbon well from a well casing head or a structure formed above the well casing head. Split tubing hangers generally support the weight of the tubing string, but do not prevent the tubing string from being raised out from the wellbore. The split tubing hanger includes a one-piece support mandrel that has a removable tubing outer sleeve that is connected and pinned in place. By removing the outer sleeve, the split tubing hanger thus allows the tubing string to be lowered below the well head to do service work, which typically requires rotating, circulating and reciprocating with the support mandrel portion of the tubing string.

Accordingly, there is a need to address one or more of the deficiencies of present tubing string rotators, safety rod clamps, and rotating split tubing hangers.

SUMMARY OF THE INVENTION

Tubing string rotators, safety rod clamps, combination tubing string rotators and safety rod clamps, and rotating split tubing hangers are provided. In some embodiments, the tubing string rotators are controllable such that they rotate the tubing string intermittently or non-continuously, which can cause even wear of the interior surface of the tubing string and extend its life.

Even wear of the interior surface of the tubing string is marked by the creation of longitudinally oriented "ribs" extending along the inner surface of the tubing, Formation of these "ribs", through even erosion and wear, is desirable because they can increase the integrity of the tubing. Intermittent or non-continuous rotation of the tubing string can contribute to creating a desired "rib effect".

According to one aspect, a tubing string rotator is provided for rotating a tubing string that is suspended in a hydrocarbon well by attachment to a rotatable support mandrel. The support mandrel can be positioned at the well casing head or well tubing head and can be supported against downward axial movement. The support mandrel can be rotatable with respect to the tubing head or well casing head such that rotation of the support mandrel causes rotation of the attached tubing string. The tubing string rotator comprises: a motor for producing a rotational force, a drive assembly for applying the rotational force to drive the rotation of the support mandrel, and a controller operatively connected to the motor for intermittently activating the motor, thereby causing rotation of the support mandrel, for selected intervals of time, followed by selected intervals of time of motor inactivation in which no rotation of the support mandrel occurs. The controller can also be used to selectively adjust the rate of rotation In some embodiments, the motor can be an electric motor. In some embodiments, the motor can be a hydraulic motor.

In some embodiments, the support mandrel comprises a support mandrel upper end and a support mandrel lower end. The upper end of the tubing string is attachable to the support mandrel lower end, and the drive assembly can be operatively connected to the support mandrel upper end.

In some embodiments, the drive assembly comprises: a plugin mandrel comprising a plugin mandrel upper end and a plugin mandrel lower end, a gear mandrel, and a drive gear. The plugin mandrel lower end can be attachable to the support mandrel upper end such that rotation of the plugin mandrel causes rotation of the support mandrel, if attached. A person skilled in the art will realize that any connection between the plugin mandrel lower end the support mandrel upper end that can transmit rotation from the plugin mandrel to the support mandrel, and resist slippage, can be used. In some embodiments, the connection between the plugin mandrel lower end and the support mandrel upper end can be a splined connection. In some embodiments, the connection between the plugin mandrel lower end and the support mandrel upper end can be a mating hexagonal connection. In some embodiments, the connection between the plugin mandrel lower end and the support mandrel upper end can be a mating keyed connection.

A gear mandrel can be mounted on the plugin mandrel upper end such that rotation of the gear mandrel causes rotation of the plugin mandrel. In some embodiments, the gear mandrel can have a set of splines formed on its exterior that extend radially outward from the gear mandrel. The mounting of the gear mandrel on the plugin mandrel can be such that rotation of the gear mandrel causes rotation of the plugin mandrel.

A drive gear can be used to drive rotation of the gear mandrel. In some embodiments, the drive gear can be an elongate drive gear. The drive gear comprises: a first end operatively connected to the motor, and a second end forming a worm gear that can be engaged with the set of splines formed on the gear mandrel, such that the rotation force produced by the motor can be applied to drive rotation of the worm gear formed on the drive gear, causing rotation of the gear mandrel, the plugin mandrel, and the support mandrel, it provided.

In some embodiments, the controller can comprise a timer device. In some embodiments, the controller can be a variable speed drive system, a variable frequency drive system, an intermittent gear system, or a variation thereof.

According to another aspect, a safety rod clamp is provided for restraining a rod from bi-axial and/or rotational movement, the safety rod clamp comprising: at least two opposed ram assemblies for engaging the rod. Each of the ram assemblies comprising: a threaded ram shaft having a first end, a replaceable, threaded ram shaft insert fitted on the ram shaft, and a rod clamp member having a v-shaped surface. The threaded rod shaft inserts can be supported against any movement with respect to the well casing head or the well tubing head. Further, the rod shaft insert can be fitted on the ram shaft such that the threads of the ram shaft engage threads of the ram shaft insert and the position of the ram shaft with respect to the ram shaft insert can be selectively adjusted by rotation of the ram shaft. The first end of the ram shaft can be exposed when the rod shaft insert is fitted on the rod shaft and the rod clamp member can be positioned on the exposed first end of the ram shaft with the v-shaped surface facing away from the ram shaft. The v-shaped surface can engage the rod to restrain movement. In some embodiments, the rod can be can be restrained by equally rotating each of the ram shafts of the least two opposed ram assemblies towards the rod until the v-shaped surface frictionally engages the rod. The shape of the v-shaped surfaces on the rod clamp member are configured so the rod clamp members can frictionally engage pump rods or coil string tubing having many different diameters without having to change the rod champ members.

In some embodiments, the v-shaped surface further can comprise an engagement surface for frictionally engaging the rod.

In some embodiments, the rotation of the rod shafts can be a manual rotation. In some embodiments, the rotation of the rod shafts can be rotation using hydraulic power.

According to another aspect, a combination tubing string rotator and safety rod clamp is provided for use at a well head of a hydrocarbon well having a production rod extending through the well head and into the well. The combination comprising: an outer housing, a tubing string rotator, as described previously, and a safety rod clamp, as described previously. The production rod can extend through the outer housing. The tubing string rotator can be positioned within the outer housing such that the plugin mandrel extends out past a lower end of the outer housing for engagement with a support mandrel upper end. The safety rod clamp can also be positioned within the outer housing above the tubing string rotator such that the at least two ram assemblies can engage the pump rod or coil tubing, when moved into contact with the rod.

BRIEF DESCRIPTION OF THE FIGURES

Embodiments of the present disclosure will now be described with reference to the accompanying Figures.

FIG. 5*a* shows a perspective view of a rod clamp member of the embodiment of the safety rod clamp shown in FIG. 4.

FIG. 5*b* shows a side elevation, cross-sectional view of a ram shaft and a ram shaft insert of the embodiment of the safety rod clamp shown in FIG. 4.

DETAILED DESCRIPTION OF EMBODIMENTS THE INVENTION

Figure 1:
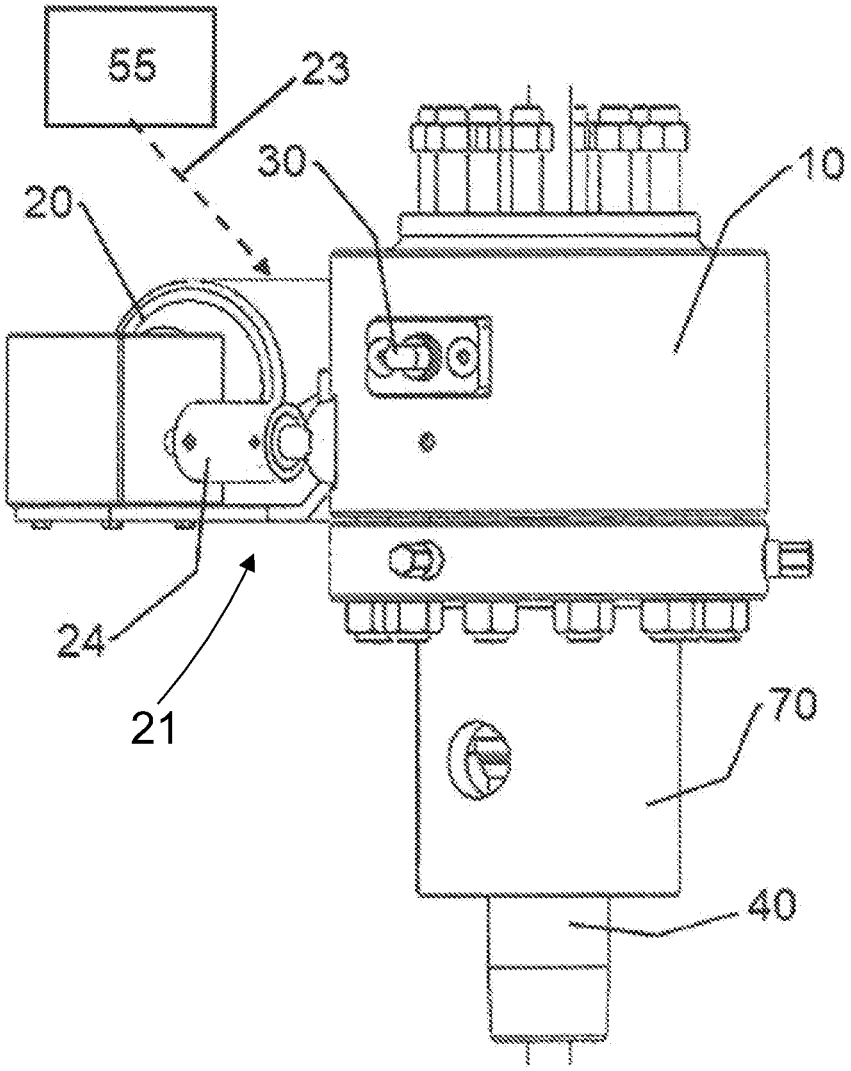
FIG. 1 shows a side elevation view of an embodiment of a combination tubing string rotator and safety rod clamp, as described herein, positioned on a well tubing head that is supporting an embodiment of a split tubing hanger, as described herein.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The term "invention" and the like mean "the one or more inventions disclosed in this application", unless expressly specified otherwise.

The terms "an aspect", "an embodiment", "embodiment", "embodiments", "the embodiment", "the embodiments", "one or more embodiments", "some embodiments", "certain embodiments". "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise. The term "plurality" means "two or more", unless expressly specified otherwise. The term "herein" means "in the present application, including anything which may be incorporated by reference", unless expressly specified otherwise.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way the scope of the disclosed invention(s). An Abstract has been included in this application merely because an Abstract of not more than 150 words is required under 37 C.F.R. Section 1.72(b) or similar law in other jurisdictions. The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Referring to FIG. 1, there is shown in side elevation view a combination tubing string rotator and safety rod clamp 10. The combination tubing string rotator and safety rod clamp 10 includes a tubing string rotator assembly 21 and a safety rod clamp 30. The combination tubing string rotator and rod clamp 10 can be positioned on a well tubing head or well casing head 70 that supports a rotatable support mandrel 40, which can be attached to a tubing string (not shown) by the lower end of support mandrel 40. Further, a motor 20 can be used to produce the rotational force necessary to rotate the support mandrel 40 and the tubing string, if attached.

Figure 2A:
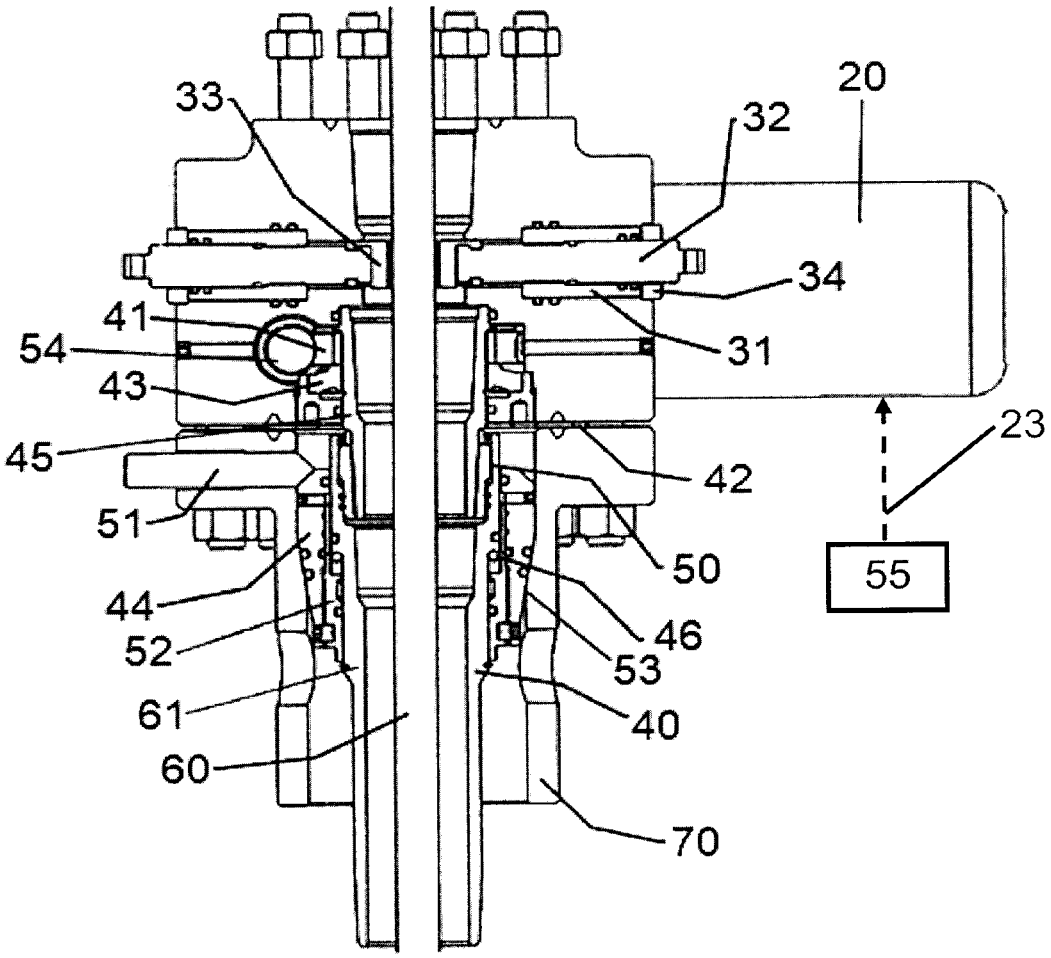
FIG. 2A shows a front elevation, cross-sectional view of a well tubing head supporting the embodiment of the split tubing hanger shown in FIG. 1, with the embodiment of a combination tubing string rotator and safety rod clamp, shown in FIG. 1, positioned on the well casing.

In some embodiments, the tubing string rotator assembly comprises a controller 55. As shown in FIGS. 1 and 2A, the controller 55 can be operationally connected to the motor 20 by connection 23. Connection 23 can be a wired or wireless connection. Alternatively, as shown in FIG. 2B, controller 55 can be integrally part of motor 20.

In some embodiments, controller 55 can be configured to automatically activate and deactivate the motor 20. By activating the motor 20, rotation of the support mandrel 40 can occur for desired or selected intervals of time, followed by selected intervals of motor inactivation in which no rotation of the support mandrel occurs. Therefore, controller 55 can create intermittent or non-continuous rotation of the support mandrel 40 and the tubing string, which can extend the wear life of the tubing string and keep the tubing string's structural integrity. Intermittent or non-continuous rotation of the tubing string may also contribute to even erosion and wear of the internal surface of the tubing string. Intermittent or non-continuous rotation of the tubing string may contribute to creating a desired "rib effect" on the inner surface of the tubing string. The controller 55 can also be used to control the rate or speed of rotation of the support mandrel 40.

Figure 2B:
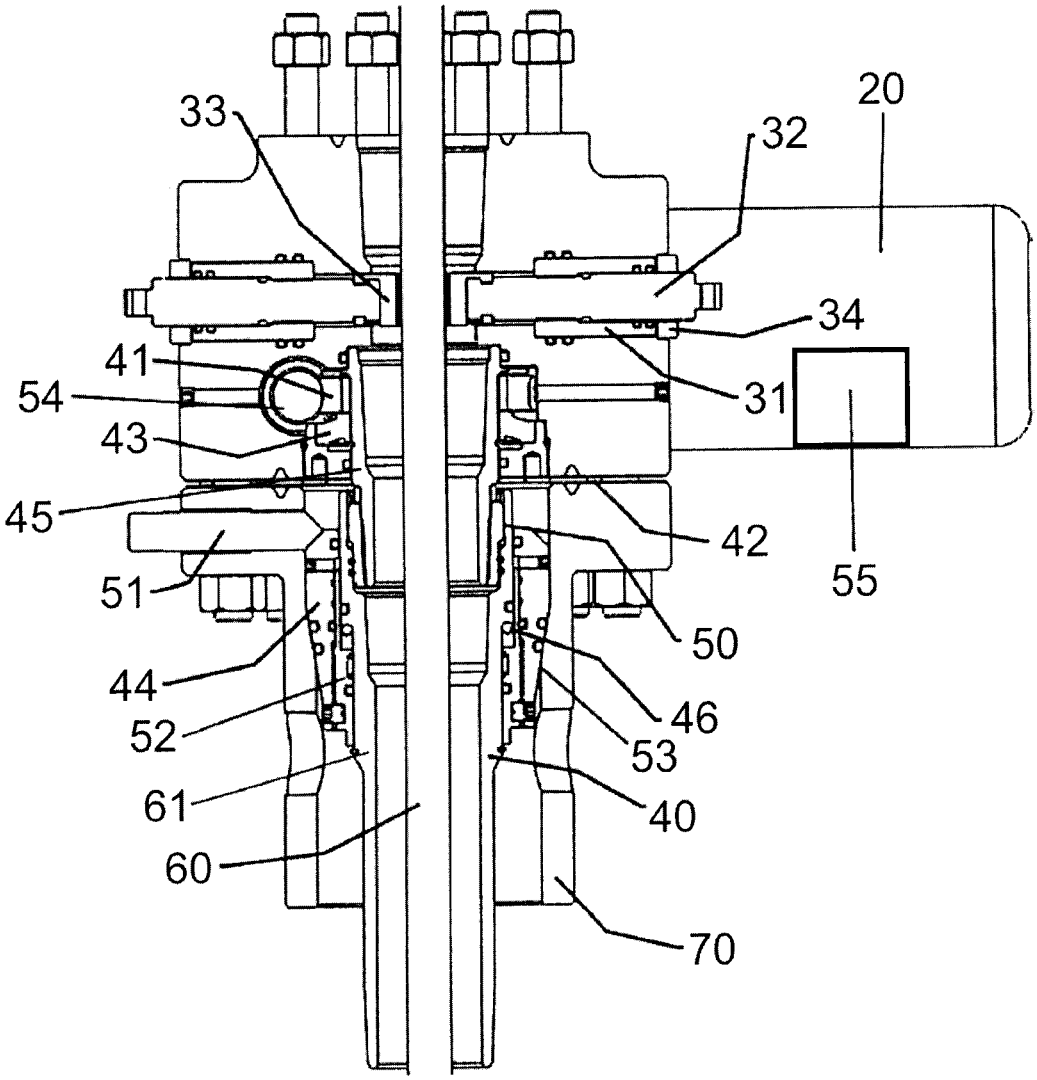
FIG. 2B shows a front elevation, cross-sectional view of a well tubing head supporting another embodiment of the split tubing hanger, having the controller integrally part of the motor, positioned on the well casing.

Referring to FIGS. 2A and 2B, there is shown in cross-section of part of a hydrocarbon well tubing head in production mode. The well head can include a well tubing head or well casing head 70 of a well casing that extends from the surface of the ground down into an oil bearing subterranean formation (not shown). The casing maintains the well in an open condition and prevents caving and sloughing of material into the well. The tubing string is situated within the casing and is hung within the well by a rotatable support mandrel 40. A variety of different types of production equipment may be positioned upon the well casing head 70 above rotating support mandrel 40, including a well head drive (not shown). A production rod 60 extends from the well head drive through the tubing string to a downhole pump located deep within the well. The production rod 60, in some instances, can be rotated by the well head drive and the rotation of the production rod 60, in turn, rotates a stator and rotor of the downhole pump (not shown) to pump hydrocarbon fluids to the surface.

The support mandrel 40 can be part of a rotating split tubing hanger 61. Also part of the rotating split tubing hanger 61, an outer sleeve 44 is mounted to the support mandrel 40 and a housing sleeve 52. Positioned between support mandrel 40 and the outer sleeve 44 is housing sleeve 52 that can be configured to allow the support mandrel 40 rotate within the outer sleeve 44, while still allowing outer sleeve 44 to be removable relative to the support mandrel 40 and the housing sleeve 52.

Figure 6:
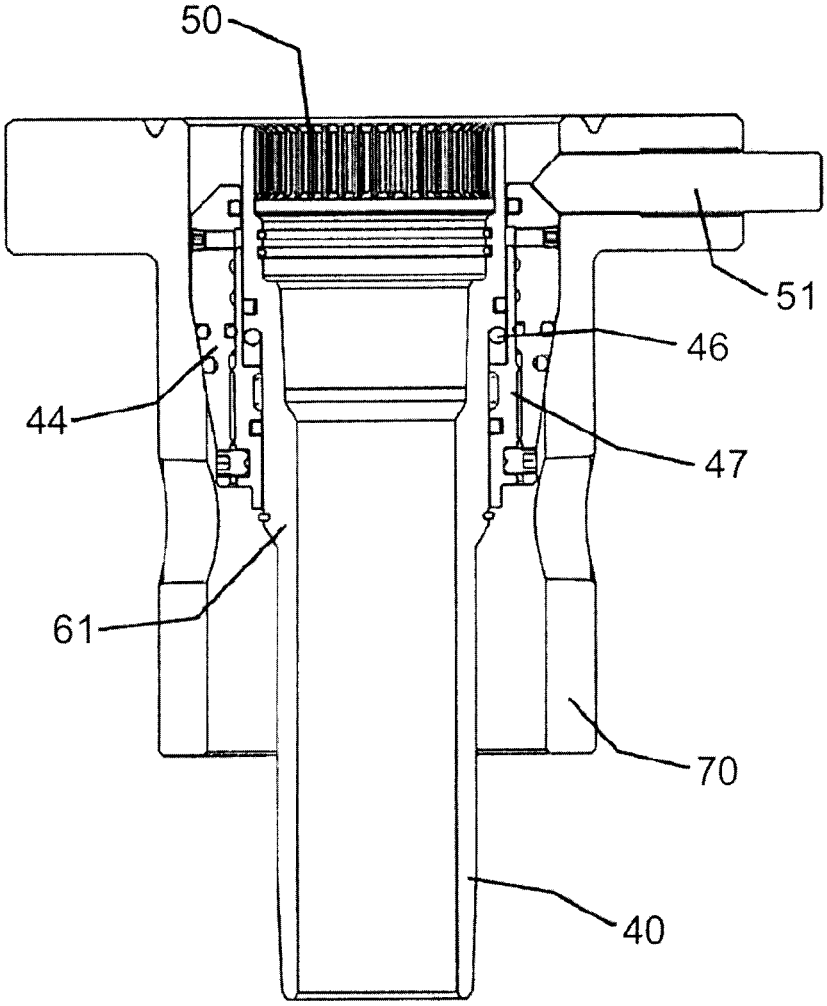
FIG. 6 shows a side elevation, cross-sectional view of the embodiment of a rotating split tubing hanger shown in FIG. 1, positioned within a well casing head.

As will be discussed further below, outer sleeve 44 can have a support surface 53 that acts as a load bearing shoulder and extends radially outward relative to housing sleeve 52 and support mandrel 40. Support surface 53 can be sized to engage the well casing head 70, as shown in FIGS. 2A, 2B, and 6, in order to support housing sleeve 52, support mandrel 40, and the tubing string, if attached, against downward axial movement. However, as there are a variety of designs for the well head equipment, the terms "well tubing head", "well casing head" and "rotating split tubing hanger" are used in a broad sense to include any structure and/or device from which a tubing string may be hung or supported.

The tubing string rotator assembly 21 can be used to rotate the tubing string so that erosion and wear of the string is evenly distributed about its inner surface. The tubing string can be rotated by rotating the support mandrel 40 to which it is attached.

In some embodiments, motor 20 can be an electric motor that uses electricity to produce the rotational force to drive rotation of the support mandrel 40. In some embodiments, motor 20 can be a hydraulic motor that uses hydraulic power to produce the rotation force that drives rotation of the support mandrel 40.

As is shown in FIGS. 2A and 2B, the drive assembly 54 can include a plugin mandrel 45 that is attachable to the upper end of the support mandrel 40, a gear mandrel 41 that is mounted on the upper end of the plugin mandrel 45, and a drive gear 22. The plugin mandrel 45 can be attached to the support mandrel so that rotation of the plugin mandrel 40 causes rotation of the support mandrel 40. A person skilled in the art will realize that any connection between the plugin mandrel lower end the support mandrel upper end that can transmit rotation from the plugin mandrel to the support mandrel, and resist slippage, can be used. In some embodiments, the connection between the plugin mandrel lower end and the support mandrel upper end can be a splined connection. In some embodiments, the connection between the plugin mandrel lower end and the support mandrel upper end can be a mating hexagonal connection. In some embodiments, the connection between the plugin mandrel lower end and the support mandrel upper end can be a mating keyed connection.

Figure 3:
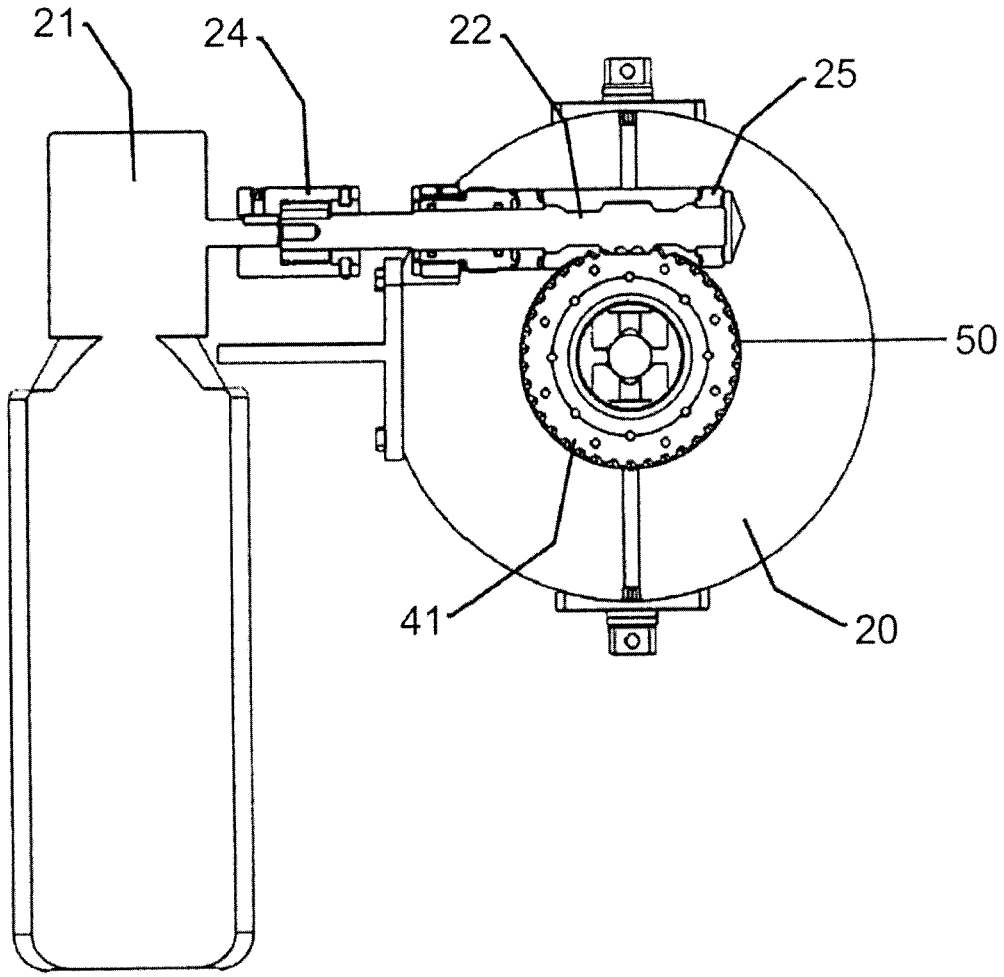
FIG. 3 show a top planar, cross-sectional view of an embodiment of a tubing string rotator, as described herein.

Referring now to FIG. 3, a set of splines 50 can extend radially outward from the gear mandrel 41, which can be used in cooperation with the drive gear 22 to rotate the gear mandrel. The drive gear 22 is connected to the motor 20 through connection 21 and also has a worm gear, formed on an opposite end of the drive gear 22, that is engaged with the splines 50 of the gear mandrel 41. As a result of this arrangement, a rotational force from the motor 20 can be transmitted through drive gear 22 to the plugin mandrel 45 through rotation of the drive gear 22 and the gear mandrel 41.

In some embodiments, a shear collar 24 can be included in drive assembly 54 with pins that are adjustable to the working torque in order to prevent over torqueing of the tubing rotator 20 to the tubing string. In some embodiments, the shear collar can be a ratcheting shear collar safety device.

In some embodiments, controller 55 can comprise a timer device, which can be used to activate and deactivate the motor 20 for desired or selected intervals of time. In some embodiments, controller 55 can be a variable speed drive, a variable frequency drive, or an intermittent gear assembly.

Figure 4:
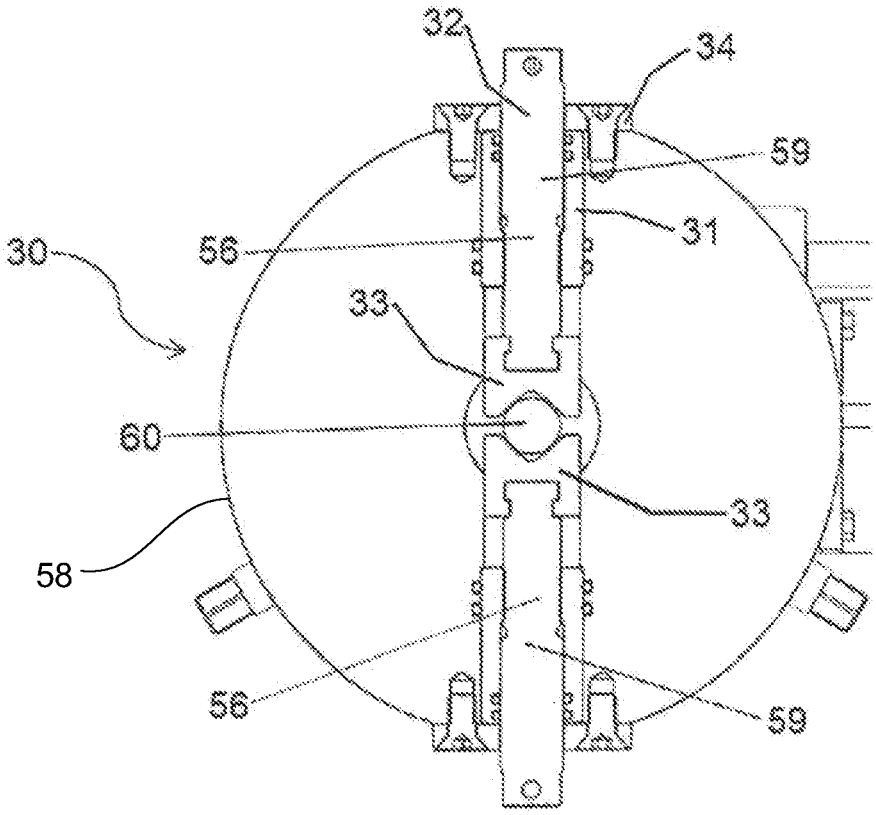
FIG. 4 shows a top planar, view cross-sectional view of an embodiment of a safety rod clamp, as described herein.

Referring to FIGS. 1 and 4, a safety rod clamp 30 is shown for clamping a production rod 60 against bi-axial and/or rotary movement with respect to the well tubing head or well casing head 70. Production rod 60 can be a pump rod, polish rod, or coil tubing that needs to be locked in position during servicing of the well. Safety rod clamp 30 can comprise at least two opposed ram assemblies 56. FIG. 4 shows two ram assemblies 56, but it will be understood that more than two ram assemblies 56 can be used. The ram assemblies 56 can comprise a ram shaft 32 positioned at opposite sides of production rod 60, ram shaft insert 31, and a rod clamp member 33. Ram assemblies 56 can be engaged with production rod 60 by moving them into frictional contact with rod 60 when, for example, the drive head (not shown) is stopped. Such a configuration can allow for service work safely. Safety rod claim 30 can be used to clamp a production rod string in a manner that allows for one of the production rods in the rod string to be replaced without having to assemble and use a larger rig assembly, as is commonly done.

Referring still to FIG. 4, in some embodiments, the safety rod clamp 30, as described herein, can use a removable ram assembly 59. Threaded shaft inserts 31 can be retained on main body 58 with retaining means, such as threaded insert retainer plate 34 and retaining bolts. The ram shaft 32 can be fitted within the insert 31 by threaded connections. Therefore, engaging the ram assemblies 56 includes equally rotating threaded ram shafts 32 (for example, with a wrench, manually, or by hydraulics) until each engages the production rod 60. Further, as depicted in FIGS. 4 and 5*a*, the ram assemblies can include a rod clamp member 33 having a v-shaped engagement surface 36 for engaging the production rod 60. The rod clamp member 33 can be positioned on the exposed end of ram shaft 32 with the v-shaped engagement surface 36 facing away from the ram shaft 32.

In some embodiments, the v-shaped engagement surface 36 can be ribbed for frictional engagement with the production rod 60. The v-shaped engagement surface 36 can be configured to fit and be engagable with a variety of production rods 60 having different sized diameters for frictional engagement that will restrain relative movement. This can decrease service time required when a different sized production rod 60 is used at the location of the well. In some embodiments, the rod clamp member 33 can be fitted with a resilient sealing member (not shown) that at least partially covers the v-shaped surface 36 for sealing the engagement of the v-shaped surface 36 with the production rod, in addition to clamping the rod. Similar to the clamping described above, the resilient sealing member is configured to seal the engagement, for example from well fluids, of the v-shaped engagement surface 36 with production rods having a variety of diameters. Also, the internal dimension, for example, the flow path through the safety clamp, can, in some embodiments, be sealed using the resilient sealing member.

Removable threaded shaft inserts 31 can be used for many kinds of threaded applications where the threads can be damaged and an insert is replaceable on location instead with a thread on the part. This can cut the operational cost when a threaded main body is damaged and a service is required without pulling the assembly or shutting the operation to repair the damage. The removable ram assembly can be replaced if the thread is damaged on the removable threaded shaft insert 31 with a new insert. This allows the main body 58 to not be removed if the threads get damaged but shut down only for the service time. This assembly can work for any moving shafts that have a threaded part to move engaging parts.

Figure 7:
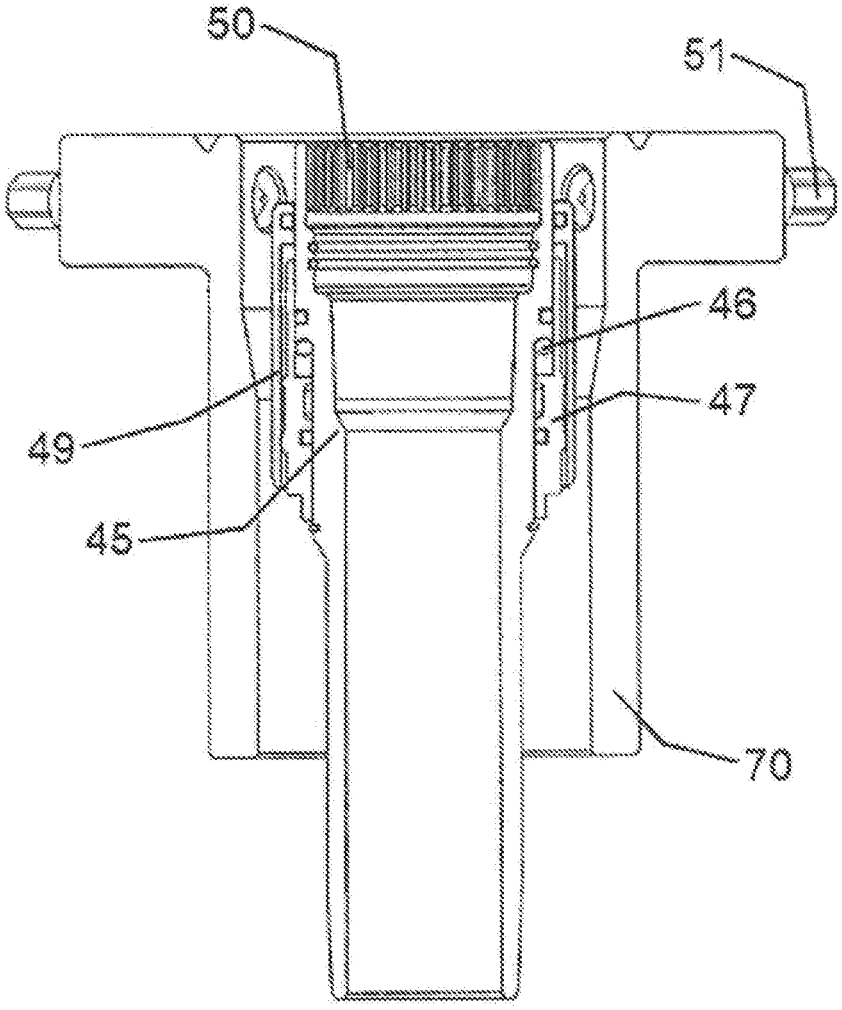
FIG. 7 shows a side elevation, cross-sectional view of the embodiment of a rotating split tubing hanger shown in FIG. 1 having a thread protector cap replacing the outer housing.

Referring to FIGS. 6 and 7, a side elevation cross-sectional view of a rotating split tubing hanger 61 is shown supported by well casing head 70. As discussed above, the combination tubing string rotator and safety rod clamp 10 can be used with the split tubing hanger 61. Thrust bearings 46 and bushing race 47 provides the hanging load rotation during rotation of the support mandrel 40 and attached tubing string. The well can be accessed for servicing by lifting tubing hanger 61 out of engagement with the casing head 70, then disconnecting and removing the outer sleeve 44. Before lifting tubing hanger 61, dog nut 51 must be disengaged with the top of the outer sleeve 44, allowing the tubing hanger 61 to be lifted. Thread protector cap 49, as shown in FIG. 7, can, in some embodiments, be placed on housing sleeve 52. The thread protector cap 49 lacks the support surface 53, allowing support mandrel 40, the housing sleeve 52, support mandrel 40, and the tubing string (not shown) to be lowered into the well, following which maintenance can be performed with the tubing string. The thread protector cap 49 can protect the housing sleeve 52 and support mandrel 40 from damage while positioned down in the well. The maintenance may include rotating the tubing string, circulating fluid or gas through the tubing string and/or torqueing through the tubing string up to the maximum torque the tubing string will permit.

Changes can be made to the present tubing string rotator assemblies, safety rod clamps, and combinations of a tubing string rotator and a safety rod clamp in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

What is claimed is:

1. A tubing string rotator assembly for driving rotation of a tubing string suspended from a rotatable support mandrel, the suspension of the tubing string being such that rotation of the support mandrel causes rotation of the tubing string, the tubing string rotator assembly comprising:

a motor for producing a rotational force;

a drive assembly operatively connected to the motor and the support mandrel, the drive assembly for applying the rotational force to drive rotation of the support mandrel and the tubing string, the support mandrel comprising a support mandrel upper end and a support mandrel lower end, and the drive assembly comprising:

a plugin mandrel comprising a plugin mandrel upper end and a plugin mandrel lower end, the plugin mandrel lower end coupled to the support mandrel upper end such that rotation of the plugin mandrel causes rotation of the support mandrel;

a gear mandrel mounted on the plugin mandrel upper end such that rotation of the gear mandrel causes rotation of the plugin mandrel; and a controller operatively connected to, or integrally part of, the motor for intermittently activating, and selectively controlling the operation of, the motor, causing a desired rotation of the support mandrel, for selected intervals of time, followed by selected intervals of time of motor inactivation, in which no rotation of the support mandrel occurs.

2. The tubing string rotator assembly according to claim 1, wherein the motor is an electrical motor.

3. The tubing string rotator assembly according to claim 1, wherein the motor is a hydraulic motor.

4. The tubing string rotator assembly according to claim 1, wherein the tubing string is attached to the support mandrel lower end, and the drive assembly is connected to the support mandrel upper end to drive rotation of the support mandrel.

5. The tubing string rotator assembly according to claim 4, wherein:

the plugin mandrel lower end is coupled to the support mandrel upper end by a plugin mandrel connection assembly;

the gear mandrel comprises a set of splines formed on an exterior surface of the gear mandrel, the set of splines extending radially outward; and the drive assembly further comprises a drive gear comprising a first end operatively connected to the motor, and a second end forming a worm gear engaged with the set of splines such that the rotational force produced by the motor is applied to drive rotation of the drive gear, causing rotation of the gear mandrel, the plugin mandrel, and the support mandrel.

6. The tubing string rotator assembly according to claim 5, wherein the drive assembly further comprises a ratcheting shear collar safety device.

7. The tubing string rotator according to claim 5, wherein the plugin mandrel connection assembly is a splined connection, a hexagonal connection, a keyed connection, or a tubing hanger holding the tubing string weight.

8. The tubing string rotator assembly according to claim 1, wherein the controller comprises a timer device, a variable speed drive, a variable frequency drive, an intermittent gear assembly, or variation thereof.

9. A combination tubing rotator and safety rod clamp system for use at a well head of a hydrocarbon well having a pump rod or coil tubing extending through the well head and into the well, the combination comprising:

an outer housing having an outer housing upper end and an outer housing lower end, the outer housing positionable such that the pump rod or coil tubing extend through a bore formed by the outer housing;

a tubing string rotator assembly for driving rotation of a tubing string suspended from a rotatable support mandrel, the tubing string rotator assembly comprising a drive assembly operable for connection to a motor and connected to the support mandrel, the drive assembly for applying a rotational force to drive rotation of the support mandrel and the tubing string, the support mandrel comprising a support mandrel upper end and a support mandrel lower end, and the drive assembly comprising:

a plugin mandrel comprising a plugin mandrel upper end and a plugin mandrel lower end, the plugin mandrel lower end coupled to the support mandrel upper end such that rotation of the plugin mandrel causes rotation of the support mandrel, wherein the plugin mandrel lower end extends past the outer housing lower end for engagement with the support mandrel upper end; and a gear mandrel mounted on the plugin mandrel upper end, within the outer housing, such that rotation of the gear mandrel causes rotation of the plugin mandrel; and a safety rod clamp positioned within the outer housing above the support mandrel, the safety rod clamp comprising a ram shaft insert mounted within the outer housing.

10. The combination tubing rotator and safety rod clamp system of claim 9, wherein the tubing string is attached to the support mandrel lower end, and the drive assembly is connected to the support mandrel upper end to drive rotation of the support mandrel.

11. The combination tubing rotator and safety rod clamp system of claim 10, wherein:

the plugin mandrel lower end is coupled to the support mandrel upper end by a plugin mandrel connection assembly;

the gear mandrel comprises a set of splines formed on an exterior surface of the gear mandrel, the set of splines extending radially outward; and the drive assembly further comprises a drive gear comprising a first end operatively connected to the motor, and a second end forming a worm gear engaged with the set of splines such that the rotational force produced by the motor is applied to drive rotation of the drive gear, causing rotation of the gear mandrel, the plugin mandrel, and the support mandrel.

12. The combination tubing rotator and safety rod clamp system of claim 11, wherein the drive assembly further comprises a ratcheting shear collar safety device.

13. The combination tubing rotator and safety rod clamp system of claim 11, wherein the plugin mandrel connection assembly is a splined connection, a hexagonal connection, a keyed connection, or a tubing hanger holding the tubing string weight.

* * * * *